US011798479B1

(12) United States Patent
Zhou et al.

(10) Patent No.: US 11,798,479 B1
(45) Date of Patent: Oct. 24, 2023

(54) PIXEL CIRCUIT, DISPLAY PANEL, AND DISPLAY DEVICE

(71) Applicant: HKC CORPORATION LIMITED, Guangdong (CN)

(72) Inventors: Renjie Zhou, Guangdong (CN); Baohong Kang, Guangdong (CN)

(73) Assignee: HKC CORPORATION LIMITED, Shenzhen (CN)

( * ) Notice: Subject to any disclaimer, the term of this patent is extended or adjusted under 35 U.S.C. 154(b) by 0 days.

(21) Appl. No.: 18/337,962

(22) Filed: Jun. 20, 2023

(30) Foreign Application Priority Data

Sep. 6, 2022 (CN) ..... 202211081405.3

(51) Int. Cl.
*G09G 3/3241* (2016.01)

(52) U.S. Cl.
CPC ... *G09G 3/3241* (2013.01); *G09G 2300/0861* (2013.01); *G09G 2310/0251* (2013.01)

(58) Field of Classification Search
CPC .. G09G 3/3266; G09G 3/3233; G09G 3/3241; G09G 2300/0861; G09G 2310/0251
See application file for complete search history.

(56) References Cited

U.S. PATENT DOCUMENTS

2005/0190128 A1 9/2005 Hayafuji
2005/0190129 A1 9/2005 Adachi
2006/0092993 A1 5/2006 Frankel
2006/0249653 A1 11/2006 Gazeley
2008/0191976 A1 8/2008 Nathan et al.
2017/0110052 A1 4/2017 Kuo
2017/0221418 A1* 8/2017 Xiang ..... G09G 3/3233
2018/0301085 A1 10/2018 Han

FOREIGN PATENT DOCUMENTS

CN 1388498 A 1/2003
CN 1677465 A 10/2005
CN 1694149 A 11/2005
CN 101939776 A 1/2011
(Continued)

OTHER PUBLICATIONS

The first office action issued in corresponding CN application No. 202211081405.3 dated Oct. 17, 2022.
(Continued)

*Primary Examiner* — Michael A Faragalla
(74) *Attorney, Agent, or Firm* — HAUPTMAN HAM, LLP

(57) ABSTRACT

A pixel circuit, a display panel, and a display device are provided in the disclosure. A first transistor of the pixel circuit receives a data signal and a first scan signal, and the first scan signal controls the first transistor to be turned on or turned off. A first terminal of a third transistor receives a second power supply voltage, a second terminal of the third transistor is electrically connected to a first terminal of a light emitting element, and a second terminal of the light emitting element receives a first power supply voltage. A first terminal of a storage capacitor is electrically connected to a second terminal of the first transistor and a control terminal of the third transistor. The pixel circuit further includes a second transistor.

20 Claims, 9 Drawing Sheets

(56) References Cited

FOREIGN PATENT DOCUMENTS

| | | | |
|---|---|---|---|
| CN | 103474023 | A | 12/2013 |
| CN | 103927985 | A | 7/2014 |
| CN | 104103238 | A | 10/2014 |
| CN | 104217681 | A | 12/2014 |
| CN | 104575395 | A | 4/2015 |
| CN | 104637445 | A | 5/2015 |
| CN | 104867456 | A | 8/2015 |
| CN | 105225626 | A | 1/2016 |
| CN | 107135360 | A | 9/2017 |
| CN | 109686311 | A | 4/2019 |
| CN | 109727570 | A | 5/2019 |
| CN | 111312162 | A | 6/2020 |
| CN | 112823386 | A | 5/2021 |
| FR | 2909818 | A | 6/2008 |
| JP | 2014178190 | A | 9/2014 |
| JP | 2019174514 | A | 10/2019 |
| KR | 20070038403 | A | 4/2007 |
| TW | 200744053 | A | 12/2007 |

OTHER PUBLICATIONS

The second office action issued in corresponding CN application No. 202211081405.3 dated Nov. 28, 2022.
Notice of allowance issued in corresponding CN application No. 202211081405.3 dated Dec. 6, 2022.

* cited by examiner

PIXEL CIRCUIT, DISPLAY PANEL, AND DISPLAY DEVICE

CROSS-REFERENCE TO RELATED APPLICATION(S)

This application claims priority under 35 U.S.C. § 119(a) to Chinese Patent Application Serial No. 202211081405.3, filed Sep. 6, 2022, the entire disclosure of which is incorporated herein by reference.

TECHNICAL FIELD

This disclosure relates to the field of display technology, and in particular to a pixel circuit, a display panel having the pixel circuit, and a display device having the display panel.

BACKGROUND

With the development of display technology, organic light-emitting diode (OLED) display panels are widely used in the field of high performance display by virtue of high density, wide viewing angle, uniform image quality, fast response time, and low power consumption. Active-matrix organic light-emitting diode (AMOLED) display panels include multiple pixel units, each pixel unit is provided with at least two transistors and one capacitor. Considering the problems of non-uniform brightness and ghosting of a display image on the AMOLED display panel, more thin film transistors (TFTs) are generally disposed in the pixel unit to drive the light-emitting element of the pixel unit to emit light.

However, whether for the OLED display panel or the AMOLED display panel, the above method will increase the complexity of the drive architecture and is still unable to solve the non-uniform brightness of the display image due to compensation problems, especially for large-size display panels.

SUMMARY

In a first aspect, a pixel circuit is provided in the disclosure. The pixel circuit includes a first transistor, a third transistor, a storage capacitor, and a light-emitting element, a control terminal of the first transistor is configured to receive a first scan signal, a first terminal of the first transistor is configured to receive a data signal, and the first transistor is configured to be turned on or turned off according to the first scan signal, where a control terminal of the third transistor is electrically connected to a second terminal of the first transistor, a first terminal of the third transistor is electrically connected to a second power supply terminal to receive a second power supply voltage, a second terminal of the third transistor is electrically connected to a first terminal of the light-emitting element, a second terminal of the light-emitting element is electrically connected to a first power supply terminal to receive a first power supply voltage, a first terminal of the storage capacitor is electrically connected to the second terminal of the first transistor and the control terminal of the third transistor, and a second terminal of the storage capacitor is electrically connected to the first power supply terminal, and where the pixel circuit further includes a second transistor, a control terminal of the second transistor is electrically connected to the second terminal of the first transistor, the control terminal of the third transistor, and the first terminal of the storage capacitor, a first terminal of the second transistor is electrically connected to the second terminal of the first transistor, and a second terminal of the second transistor is electrically connected to the first power supply terminal.

In some implementations, when the first scan signal is at a first potential, the first transistor is in an on state, and the data signal is transmitted to the storage capacitor to charge the storage capacitor; when a voltage of the storage capacitor reaches a preset voltage value, the second transistor and the third transistor are turned on, the second power supply voltage flows through the third transistor and is transmitted to the light-emitting element, and the second power supply voltage drives the light-emitting element to emit light; and when the first scan signal is at a second potential, the first transistor is in an off state.

In some implementations, the pixel circuit further includes a fourth transistor, a control terminal of the fourth transistor is configured to receive a second scan signal, a first terminal of the fourth transistor is configured to receive a threshold voltage, and a second terminal of the fourth transistor is electrically connected to the first terminal of the storage capacitor; and the second scan signal is configured to control the threshold voltage to be selectively transmit to the storage capacitor to provide a pre-charge voltage for the storage capacitor.

In some implementations, when the second scan signal received at the control terminal of the fourth transistor is at a first potential, the fourth transistor is in an on state, and the threshold voltage provides the pre-charge voltage for the storage capacitor; and when the second scan signal received at the control terminal of the fourth transistor is at a second potential, the fourth transistor is in an off state, and the threshold voltage stops providing the pre-charge voltage for the storage capacitor.

In some implementations, the pixel circuit further includes a fifth transistor, a first terminal of the fifth transistor is electrically connected to both the second terminal of the first transistor and the first terminal of the second transistor, and a second terminal of the fifth transistor is electrically connected to the second terminal of the fourth transistor; and a control terminal of the fifth transistor is configured to receive the first scan signal or a third scan signal.

In some implementations, the control terminal of the fifth transistor is configured to receive the third scan signal, and when the first scan signal is at a second potential and the second scan signal and the third scan signal each are at a first potential, the first transistor is in an off state, the fourth transistor and the fifth transistor are in an on state, and the fifth transistor and the fourth transistor provide the pre-charge voltage for the storage capacitor; and when the first scan signal and the third scan signal are at the first potential and the second scan signal is at the second potential, the first transistor and the fifth transistor are in the on state, the fourth transistor is in the off state, and the data signal charges the storage capacitor; or the control terminal of the fifth transistor is configured to receive the first scan signal, and when the first scan signal is at the first potential and the second scan signal is at the second potential, the first transistor and the fifth transistor each are in the on state, and the fourth transistor is in the off state, and the data signal flows through the first transistor and the fifth transistor to charge the storage capacitor; and when the first scan signal is at the second potential and the second scan signal is at the first potential, the first transistor and the fifth transistor each are in the off state, the fourth transistor is in the on state, and the fourth transistor and the fifth transistor provide the pre-charge voltage for the storage capacitor.

In some implementations, the pixel circuit further includes a resistor, one terminal of the resistor is electrically connected to the second terminal of the second transistor, and the other terminal of the resistor is electrically connected to the first power supply terminal.

In some implementations, the pixel circuit further includes a sixth transistor, a control terminal of the sixth transistor is configured to receive the first scan signal, a first terminal of the sixth transistor is electrically connected to the control terminal of the second transistor, and a second terminal of the sixth transistor is electrically connected to the control terminal of the third transistor.

In a second aspect, a display panel is further provided in the disclosure. The display panel includes the above pixel circuit, where the pixel circuit is configured to display an image on the display panel.

In a third aspect, a display device is further provided in the disclosure. The display device includes the above display panel.

Figure 1:
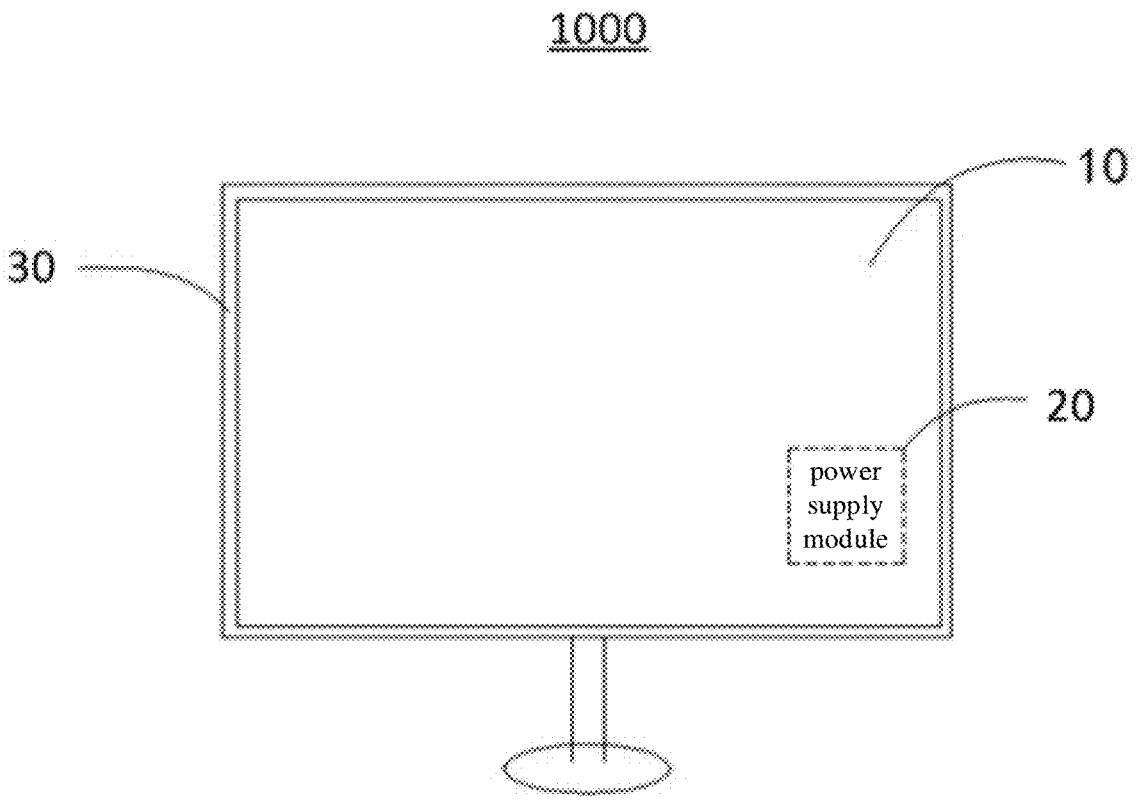
FIG. 1 is a schematic diagram of a structure of a display device disclosed in implementations of the disclosure.

Description of reference numbers is as follows.

1000—display device; 10—display panel; 20—power supply module; 30—support frame; 11—display region; 13—non-display region; 40, 50, 60, 66, 70, 77—pixel circuit; 41—first transistor; 42—second transistor; 43—storage capacitor; 44—third transistor; 45—light-emitting element; 51—fourth transistor; 61—fifth transistor; 71—sixth transistor; S1~Sn—scan lines; D1~Dm—data lines; F1—first direction; F2—second direction; Scan—scan signal; Data—data signal; Vref—threshold voltage; Scan a—first scan signal; Scan b—second scan signal; Scan c—third scan signal; VSS—first power supply voltage; VDD—second power supply voltage; Rd—resistance; Idata—first current; I2—second current; I3—third current; Ids—fourth current.

DETAILED DESCRIPTION

To facilitate understanding of the disclosure, the disclosure will be described in details below with reference to the related drawings. The preferred implementations of the disclosure are shown in the drawings. However, the disclosure may be implemented in many different forms and is not limited to the implementations described herein. Rather, these implementations are provided for a thorough and complete understanding of the disclosure.

The following descriptions of various embodiments are with reference to the accompanying figures to illustrate the specific embodiments that can be implemented by the disclosure. The serial numbers themselves, such as "first", "second", etc., for the components herein are only used to distinguish the described objects, and do not have any order or technical meaning. Furthermore, the "connection" and "coupling" mentioned in the disclosure, unless otherwise specified, include both direct and indirect connection (coupling). Directional terms mentioned in the disclosure, such as "upper", "lower", "front", "rear", "left", "right", "inner", "outer", "side", etc., are merely references of directions of the accompanying drawings. Accordingly, the directional terms are used for better and clearer description and understanding of the disclosure, rather than indicating or implying that the referred device or element must have a particular orientation, be constructed and operate in a particular orientation. Therefore, it should not be construed as a limitation on the disclosure.

In the description of the disclosure, it should be noted that, unless otherwise expressly specified and limited, the terms "installed", "connected", and "coupled" should be understood in a broad sense. For example, it may be a fixed connection, a detachable connection, or an integral connection; a mechanical connection; a direct connection, an indirect connection through an intermediate medium, or an internal communication between two components. For those of ordinary skill in the art, the specific meanings of the above terms in the disclosure can be understood in specific situations. It should be noted that the terms "first", "second" and the like in the description, claims, and drawings of the disclosure are used to distinguish different objects, rather than to describe a specific order. In addition, the terms "include", "can include", "contain", or "can contain" used in the disclosure indicate the existence of the disclosed corresponding functions, operations, elements, etc., and do not limit other one or more functions, operations, components, etc. Furthermore, the terms "include" or "contain" mean corresponding features, numbers, steps, operations, elements, components, or combinations thereof disclosed in the specification, without excluding the presence or addition of one or more other features, numbers, steps, operations, elements, components, or combinations thereof, and are intended to cover the non-exclusive inclusion. It should also be understood that "at least one" as described herein means one or more such as one, two, three, or the like and "multiple" means at least two such as two, three, or the like, unless otherwise specifically defined. The terms "step 1", "step 2", etc. in the specification and claims and the accompanying drawings of the disclosure are used to distinguish between different objects and are not intended to describe a particular sequence.

Unless otherwise defined, all technical and scientific terms used herein have the same meaning as commonly understood by one of ordinary skill in the technical field to which the disclosure belongs. The terms used herein in the specification of the disclosure are merely for describing the implementations but are not intended to limit the disclosure.

In view of the shortcomings of the related art, the disclosure aims to provide a pixel circuit, and a display panel, where a second transistor is disposed in the pixel circuit and a structure of the pixel circuit is further optimized and improved, to avoid the problem of non-uniform brightness or ghosting of a display image on the display panel.

A pixel circuit is provided in the disclosure. The pixel circuit includes a first transistor, a third transistor, a storage capacitor, and a light-emitting element, a control terminal of the first transistor is configured to receive a first scan signal, a first terminal of the first transistor is configured to receive a data signal, and the first transistor is configured to be turned on or turned off according to the first scan signal, where a control terminal of the third transistor is electrically connected to a second terminal of the first transistor, a first terminal of the third transistor is electrically connected to a second power supply terminal to receive a second power supply voltage, a second terminal of the third transistor is electrically connected to a first terminal of the light-emitting element, a second terminal of the light-emitting element is electrically connected to a first power supply terminal to receive a first power supply voltage, a first terminal of the storage capacitor is electrically connected to the second terminal of the first transistor and the control terminal of the third transistor, and a second terminal of the storage capacitor is electrically connected to the first power supply terminal, and where the pixel circuit further includes a second transistor, a control terminal of the second transistor is electrically connected to the second terminal of the first transistor, the control terminal of the third transistor, and the first terminal of the storage capacitor, a first terminal of the second transistor is electrically connected to the second terminal of the first transistor, and a second terminal of the second transistor is electrically connected to the first power supply terminal.

In some implementations, when the first scan signal is at a first potential, the first transistor is in an on state, and the data signal is transmitted to the storage capacitor to charge the storage capacitor; when a voltage of the storage capacitor reaches a preset voltage value, the second transistor and the third transistor are turned on, the second power supply voltage flows through the third transistor and is transmitted to the light-emitting element, and the second power supply voltage drives the light-emitting element to emit light; and when the first scan signal is at a second potential, the first transistor is in an off state.

In some implementations, the pixel circuit further includes a fourth transistor, a control terminal of the fourth transistor is configured to receive a second scan signal, a first terminal of the fourth transistor is configured to receive a threshold voltage, and a second terminal of the fourth transistor is electrically connected to the first terminal of the storage capacitor; and the second scan signal is configured to control the threshold voltage to be selectively transmit to the storage capacitor to provide a pre-charge voltage for the storage capacitor.

In some implementations, when the second scan signal received at the control terminal of the fourth transistor is at a first potential, the fourth transistor is in an on state, and the threshold voltage provides the pre-charge voltage for the storage capacitor; and when the second scan signal received at the control terminal of the fourth transistor is at a second potential, the fourth transistor is in an off state, and the threshold voltage stops providing the pre-charge voltage for the storage capacitor.

In some implementations, the pixel circuit further includes a fifth transistor, a first terminal of the fifth transistor is electrically connected to both the second terminal of the first transistor and the first terminal of the second transistor, and a second terminal of the fifth transistor is electrically connected to the second terminal of the fourth transistor; and a control terminal of the fifth transistor is configured to receive the first scan signal or a third scan signal.

In some implementations, the control terminal of the fifth transistor is configured to receive the third scan signal, and when the first scan signal is at a second potential and the second scan signal and the third scan signal each are at a first potential, the first transistor is in an off state, the fourth transistor and the fifth transistor are in an on state, and the fifth transistor and the fourth transistor provide the pre-charge voltage for the storage capacitor; and when the first scan signal and the third scan signal are at the first potential and the second scan signal is at the second potential, the first transistor and the fifth transistor are in the on state, the fourth transistor is in the off state, and the data signal charges the storage capacitor; or the control terminal of the fifth transistor is configured to receive the first scan signal, and when the first scan signal is at the first potential and the second scan signal is at the second potential, the first transistor and the fifth transistor each are in the on state, and the fourth transistor is in the off state, and the data signal flows through the first transistor and the fifth transistor to charge the storage capacitor; and when the first scan signal is at the second potential and the second scan signal is at the first potential, the first transistor and the fifth transistor each are in the off state, the fourth transistor is in the on state, and the fourth transistor and the fifth transistor provide the pre-charge voltage for the storage capacitor.

In some implementations, the pixel circuit further includes a resistor, one terminal of the resistor is electrically connected to the second terminal of the second transistor, and the other terminal of the resistor is electrically connected to the first power supply terminal.

In some implementations, the pixel circuit further includes a sixth transistor, a control terminal of the sixth transistor is configured to receive the first scan signal, a first terminal of the sixth transistor is electrically connected to the control terminal of the second transistor, and a second terminal of the sixth transistor is electrically connected to the control terminal of the third transistor.

A display panel is further provided in the disclosure. The display panel includes the above pixel circuit, where the pixel circuit is configured to display an image on the display panel.

A display device is further provided in the disclosure. The display device includes the above display panel.

In conclusion, in the pixel circuit, the display panel, and the display device of the disclosure, the second transistor is provided, and since the second transistor and the third transistor operate in the active region and are voltage-controlled components, and the current at the control terminal of the second transistor is approximately equal to zero, the third current flowing from the second terminal of the first transistor to the control terminal of the second transistor is approximately equal to zero. According to Kirchhoff's law, the first current flowing through the first transistor is equal to the sum of the third current flowing from the second terminal of the first transistor to the control terminal of the second transistor and the second current flowing through the second transistor, and based on this, it can be concluded that the first current is equal to the second current.

Because the second transistor and the third transistor are mirror-connected with respect to the storage capacitor, voltages at the control terminal of the second transistor and the control terminal of the third transistor are equal, and thus the second current is equal to the fourth current for driving the light-emitting element to emit light, that is, the fourth current for driving the light-emitting element to emit light is only related to the first current. In this case, the first current is determined by the data signal input to the first transistor, even if the threshold voltage drift of the driving transistor, carrier mobility deviation or inherent hysteresis effect, the impedance drop of the driving power supply voltage, or the aged light-emitting element occurs, the magnitude of the first current will not be affected. Furthermore, the magnitude of the fourth current for driving the light-emitting element to emit light will not be affected, and thus the light-emitting element can emit light normally, avoiding the problem of non-uniform brightness or ghosting of the display image on the display panel and improving the display effect.

Meanwhile, by setting the fourth transistor, or by setting the fourth transistor and the sixth transistor, or by setting the fourth transistor, the fifth transistor, and the sixth transistor, to provide the pre-charge voltage for the storage capacitor, the charging speed of the storage capacitor can be accelerated with the pre-charge voltage of the storage capacitor when the pixel circuit is in the light-emitting stage, and insufficient charging and insufficient light-emitting brightness of the light-emitting element caused by short scan time and non-uniform display or ghosting of the display image on the display panel can be avoided, thereby effectively improving the display effect and display taste of the display panel.

Referring to FIG. 1, FIG. 1 is a schematic diagram of a structure of a display device 1000 disclosed in implementations of the disclosure. As shown in FIG. 1, the display device 1000 provided in implementations of the disclosure may at least include a display panel 10, a power supply module 20, and a support frame 30. The display panel 10 is fixed to the support frame 30 and the power supply module 20 is disposed at the back of the display panel 10, i.e., the non-display surface of the display panel 10, also called the side of the display panel 10 away from the user. The display panel 10 is configured to display images, the power supply module 20 is electrically connected to the display panel 10, for providing the power supply voltage for image display of the display panel 10, and the support frame 30 is configured to provide support and protection for the display panel 10 and the power supply module 20.

It can be understood that, the display panel 10 also has a display surface opposite to the non-display surface, i.e., the front of the display panel 10, also called the side of the display panel 10 facing the user. The display surface faces the user using the display device 1000, for image display.

Figure 2:
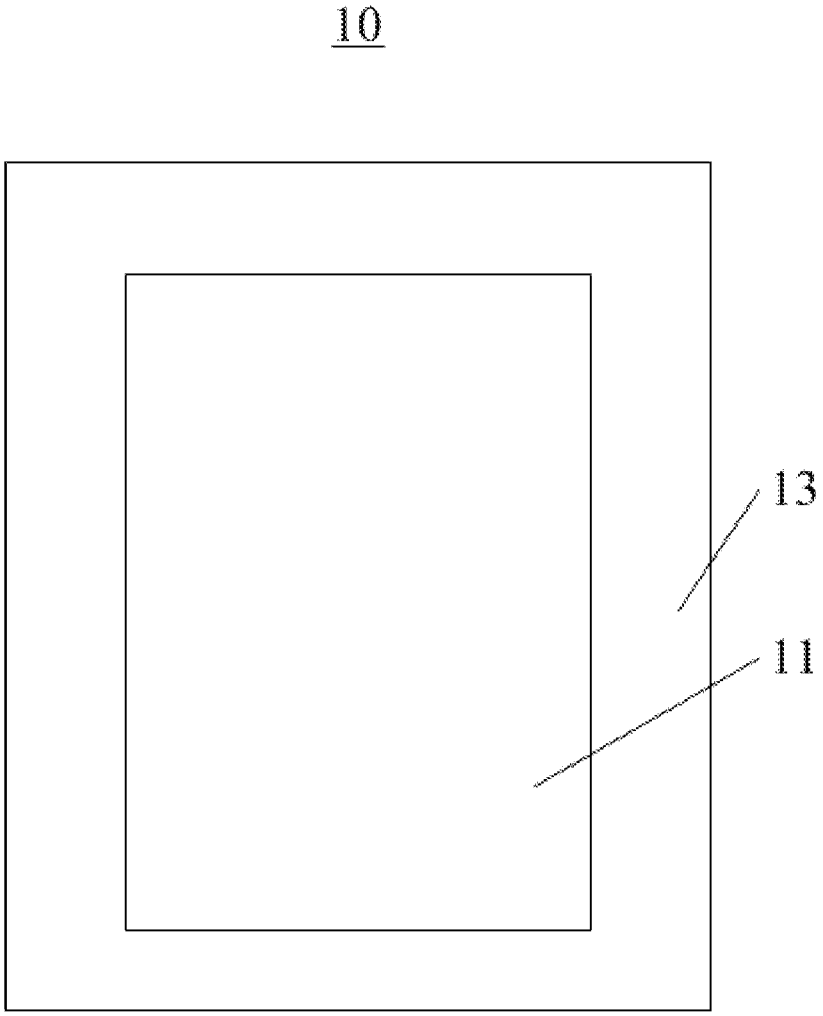
FIG. 2 is a schematic diagram of a structure of a display panel in the display device shown in FIG. 1.

Referring to FIG. 2, FIG. 2 is a schematic diagram of a structure of a display panel 10 in the display device 1000 shown in FIG. 1. As shown in FIG. 2, the display panel 10 includes a display region 11 and a non-display region 13, where the display region 11 is used for image display and the non-display region 13 is disposed around the display region 11 and is not used for image display.

Figure 3:
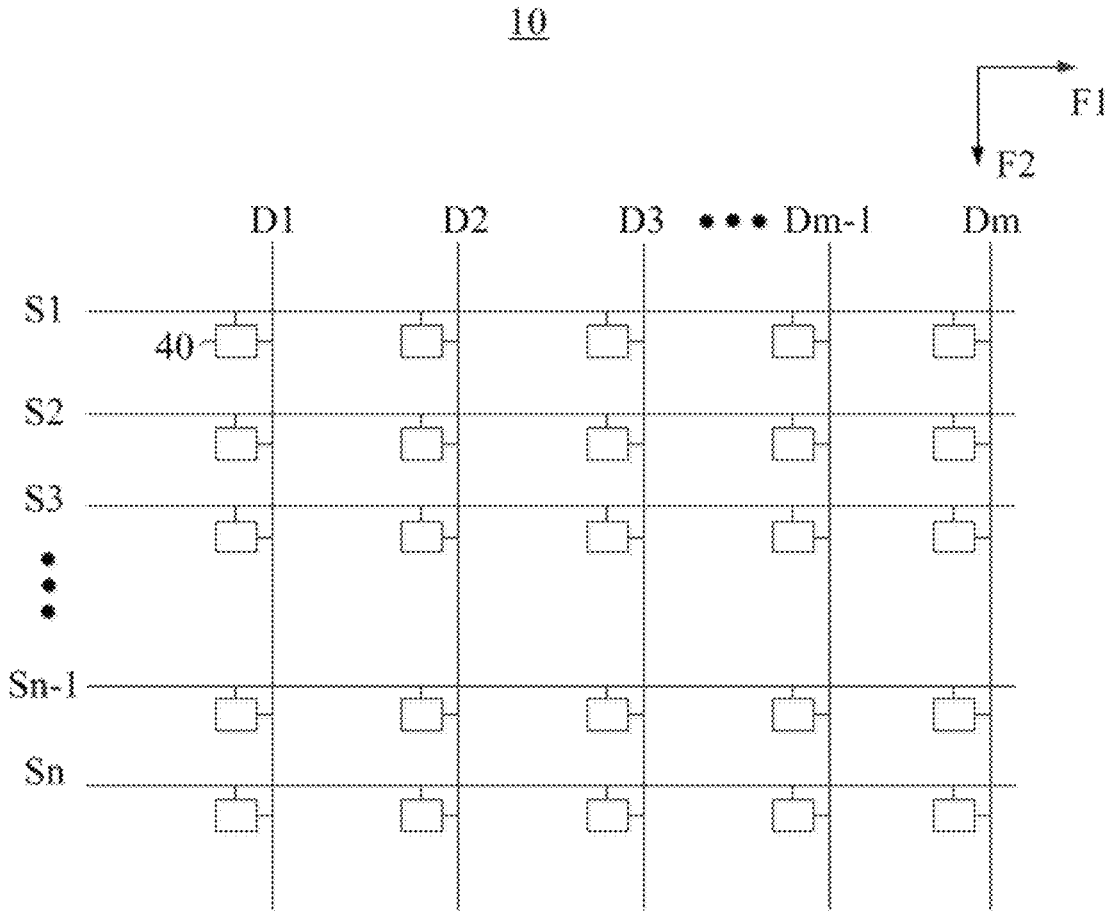
FIG. 3 is a schematic diagram of part of a structure of the display panel shown in FIG. 2.

Referring to FIG. 3, FIG. 3 is a schematic diagram of part of a structure of the display panel 10 shown in FIG. 2. As shown in FIG. 3, in implementations of the disclosure, the display panel 10 may at least include multiple scan lines S1~Sn extending along a first direction F1 and multiple data lines D1~Dm extending along a second direction F2, where the multiple scan lines S1~Sn and the multiple data lines D1~Dm are arranged in a grid pattern. The first direction F1 and the second direction F2 are perpendicular to each other, and the multiple scan lines S1~Sn are insulated from each other, the multiple data lines D1~Dm are insulated from each other, and the scan lines S1~Sn and the data lines D1~Dm are insulated from each other. That is, the multiple scan lines S1~Sn are spaced apart and insulated from each other along the second direction F2, the multiple data lines D1~Dm are spaced apart and insulated from each other along the first direction F1, and the multiple scan lines S1~Sn and the multiple data lines D1~Dm are insulated from each other.

The pixel circuits 40 are located at intersections between the multiple scan lines S1~Sn and the multiple data lines D1~Dm. Specifically, one pixel circuit 40 is disposed between any two adjacent scan lines and any two adjacent data lines, the pixel circuits 40 located in the same column are electrically connected to the same the data line, and the pixel circuits 40 located in the same row are electrically connected to the same the scan line. In implementations of the disclosure, the multiple pixel circuits 40 are distributed in an array.

Figure 4:
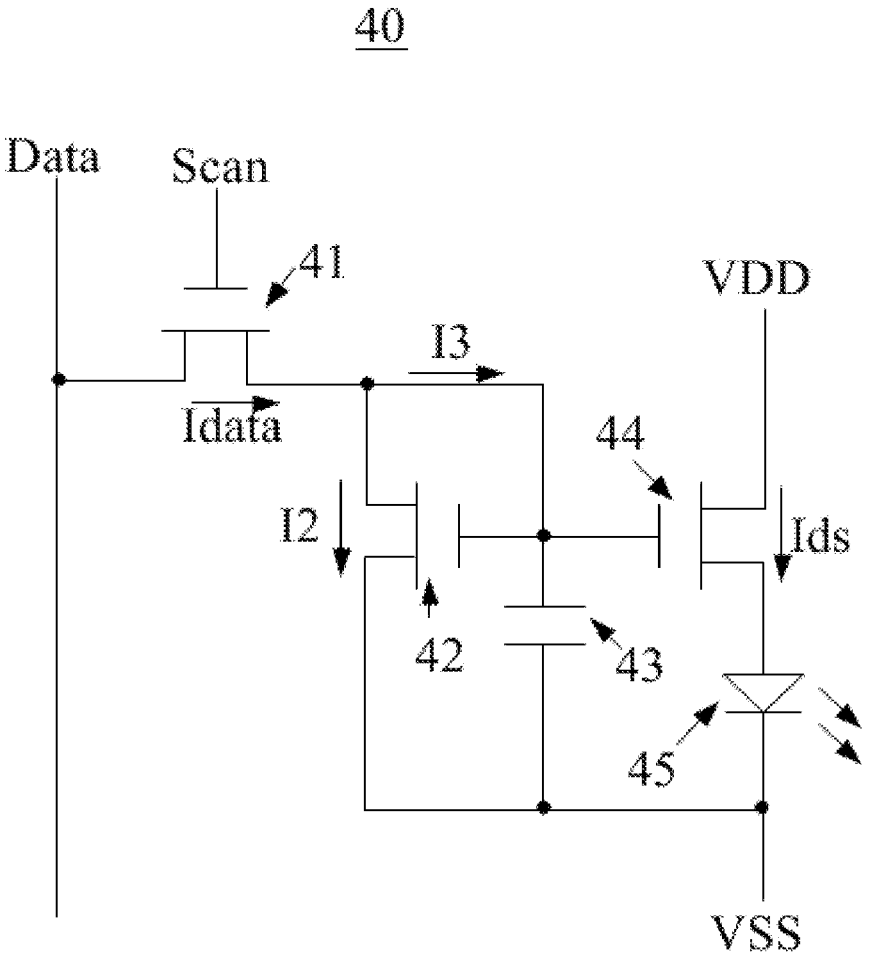
FIG. 4 is a schematic diagram of a circuit structure of a pixel circuit disclosed in a first implementation of the disclosure.

Referring to FIG. 4, FIG. 4 is a schematic diagram of a circuit structure of a pixel circuit 40 disclosed in a first implementation of the disclosure. As shown in FIG. 4, in implementations of the disclosure, the pixel circuit 40 includes a first transistor 41, a second transistor 42, a storage capacitor 43, a third transistor 44, and a light-emitting element 45. A control terminal of the first transistor 41 is electrically connected to the scan line, for receiving a scan signal Scan. A first terminal of the first transistor 41 is electrically connected to the data line, for receiving a data signal Data. A second terminal of the first transistor 41 is electrically connected to a first terminal of the second transistor 42.

A control terminal of the second transistor 42 is electrically connected to a control terminal of the third transistor 44. A second terminal of the second transistor 42 is electrically connected to a first power supply terminal, for receiving a first power supply voltage VSS. A first terminal of the third transistor 44 is electrically connected to a second power supply terminal, for receiving a second power supply voltage VDD, and a second terminal of the third transistor 44 is electrically connected to a first terminal of the light-emitting element 45. A second terminal of the light-emitting element 45 is electrically connected to the first power supply terminal, for receiving the first power supply voltage VSS. A first terminal of the storage capacitor 43 is electrically connected to both the control terminal of the second transistor 42 and the control terminal of the third transistor 44. A second terminal of the storage capacitor 43 is electrically connected to the first power supply terminal, for receiving the first power supply voltage VSS.

In implementations of the disclosure, the control terminal of the first transistor 41 is configured to receive the scan signal Scan, where the scan signal Scan is configured to control the first transistor 41 to selectively transmit the data signal Data to the first terminal of the second transistor 42. Furthermore, the first transistor 41 is configured to selectively charge the storage capacitor 43.

The first transistor 41 is in an on state when the scan signal Scan received at the first transistor 41 is at a first potential. The first transistor 41 selectively transmits the data signal Data to the first terminal of the second transistor 42, to the storage capacitor 43, and to the control terminal of the third transistor 44. At this time, the storage capacitor 43 is charged. The first transistor 41 is in an off state when the scan signal Scan received at the first transistor 41 is at a second potential.

In implementations of the disclosure, when a voltage of the storage capacitor 43 reaches a preset voltage value, the second transistor 42 and the third transistor 44 are turned on.

Furthermore, the second power supply voltage VDD flows through the third transistor 44 to transmit the light-emitting element 45, to drive the light-emitting element 45 to emit light.

In implementations of the disclosure, the pixel circuit 40 includes the first transistor 41, the third transistor 44, the storage capacitor 43, and the light-emitting element 45. The first transistor 41 includes the control terminal, the first terminal, and the second terminal, where the control terminal of the first transistor 41 is configured to receive a first scan signal, the first terminal of the first transistor 41 is configured to receive a data signal, the first scan signal is configured to control the first terminal and the second terminal of the first transistor 41 to be electrically turned on or turned off.

The third transistor 44 includes the control terminal, the first terminal, and the second terminal, where the control terminal of the third transistor 44 is electrically connected to the second terminal of the first transistor 41, the first terminal of the third transistor 44 is electrically connected to the second power supply terminal, the second terminal of the third transistor 44 is electrically connected to the first terminal of the light-emitting element 45, the second terminal of the light-emitting element 45 is electrically connected to the first power supply terminal.

The first terminal of the storage capacitor 43 is electrically connected to the second terminal of the first transistor 41 and the control terminal of the third transistor 44, and the second terminal of the storage capacitor 43 is electrically connected to the first power supply terminal.

The pixel circuit 40 further includes the second transistor 42, where the control terminal of the second transistor 42 is electrically connected to the second terminal of the first transistor 41, the control terminal of the third transistor 44, and the first terminal of the storage capacitor 43, the first terminal of the second transistor 42 is electrically connected to the second terminal of the first transistor 41, and the second terminal of the second transistor 42 is electrically connected to the first power supply terminal.

In implementations of the disclosure, the second transistor 42 and the third transistor 44 are mirror-connected with respect to the storage capacitor 43. When the second transistor 42 and the third transistor 44 operate in the active region, which are voltage-controlled components, the current at the control terminal of the second transistor 42 is approximately equal to zero. Thus, it can be concluded that the third current I3 flowing from the second terminal of the first transistor 41 to the control terminal of the second transistor 420 is approximately equal to zero.

It can be understood that, according to Kirchhoff's law, the first current Idata flowing through the first transistor 41 is equal to the sum of the third current I3 and the second current I2 flowing through the second transistor 42, i.e., the first current Idata=second current I2+third current I3. Since the third current I3 is approximately equal to zero, it follows that in the pixel circuit 40, the first current Idata=second current I2.

Furthermore, since the second transistor 42 and the third transistor 44 are mirror-connected with respect to the storage capacitor 43, the voltage VGS at the control terminal of the second transistor 42 (the voltage applied between the control terminal and the second terminal of the second transistor 42) is equal to the voltage VGS at the control terminal of the third transistor 44 (the voltage applied between the control terminal and the second terminal of the third transistor 44). Furthermore, since the second transistor 42 and the third transistor 44 are set closer, there is less loss in the current flow. It is then understood that the second current I2 is equal to the fourth current Ids for driving the light-emitting element 45 to emit light. Based on this, it can be concluded that the fourth current Ids driving the light-emitting element 45 to emit light is only related to the first current Idata. Thus, non-uniform brightness of each light-emitting element 45 of the display panel 10 due to the threshold voltage drift of the transistor, carrier mobility instability or inherent hysteresis effect, the impedance drop of the driving power supply voltage, and the aged light-emitting element 45 and non-uniform brightness or ghosting of the display image on the display panel 10 due to non-uniform brightness of each light-emitting element 45 can be avoided.

In implementations of the disclosure, the first potential may be a high potential and the second potential may be a low potential, which is not specifically limited in the disclosure.

In implementations of the disclosure, the light-emitting element 45 may be an organic light-emitting diode (OLED).

In implementations of the disclosure, the third transistor 44 serves as the transistor driving the light-emitting element 45 to emit light.

In implementations of the disclosure, the first terminal of each transistor may be a drain, the second terminal of each transistor may be a source, and the control terminal of each transistor may be a gate, which is not specifically limited in the disclosure. In the implementation, the voltage VGS applied between the gate and the source of the second transistor 42 is equal to the voltage VGS applied between the gate and the source of the third transistor 44.

In implementations of the disclosure, the first transistor 41, the second transistor 42, and the third transistor 44 are N-type field effect thin film transistors.

In implementations of the disclosure, the first terminal of the light-emitting element 45 can be the anode, the second terminal can be the cathode, which is not specifically limited in the disclosure.

In implementations of the disclosure, the first transistor 41 operates in the cut-off region and the saturation region, serving as a switch. The second transistor 42 and the third transistor 44 operate in the active region.

Figure 5:
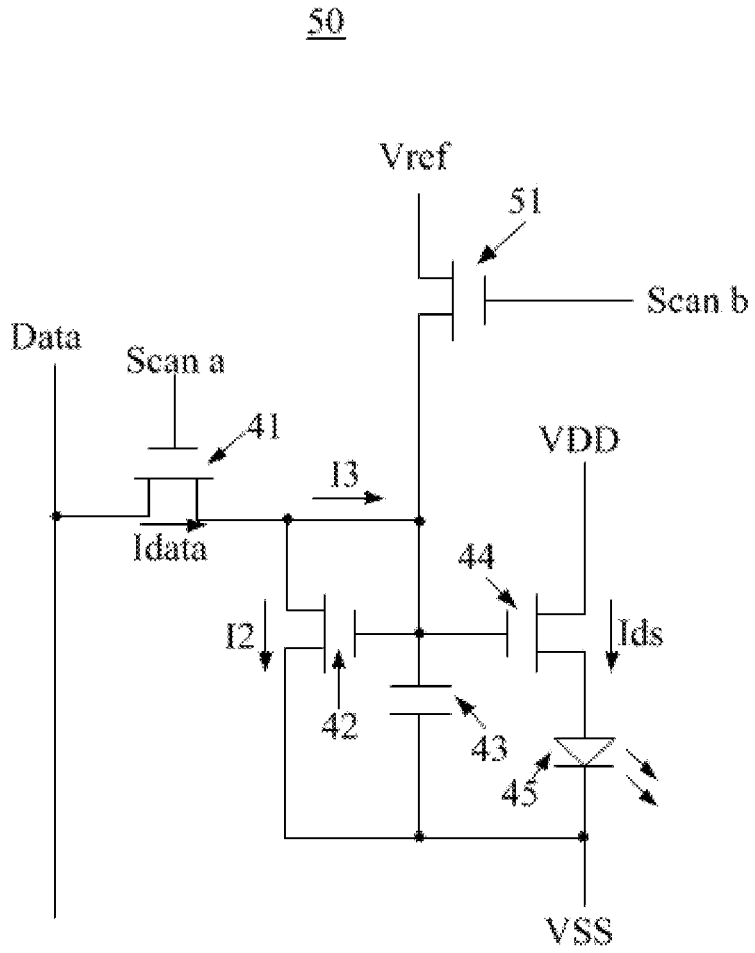
FIG. 5 is a schematic diagram of a circuit structure of a pixel circuit disclosed in a second implementation of the disclosure.

Referring to FIG. 5, FIG. 5 is a schematic diagram of a circuit structure of a pixel circuit 50 disclosed in a second implementation of the disclosure. In the implementation of the disclosure, the pixel circuit 50 disclosed in the second implementation shown in FIG. 5 differs from the pixel circuit 40 disclosed in the first implementation in that: the pixel circuit 50 further includes a fourth transistor 51, where the fourth transistor 51 includes a control terminal, a first terminal, and a second terminal. The control terminal of the fourth transistor 51 is configured to receive a scan signal.

To distinguish between the scan signal received at the first transistor 41 and the scan signal received at the fourth transistor 51, the scan signal received at the first transistor 41 is recorded as the first scan signal Scan a and the scan signal received at the fourth transistor 51 is recorded as the second scan signal Scan b.

The first terminal of the fourth transistor 51 is configured to receive a threshold voltage Vref, where the threshold voltage Vref is configured to provide the pre-charge voltage for the storage capacitor 43. The second terminal of the fourth transistor 51 is electrically connected to the first terminal of the storage capacitor 43.

In implementations of the disclosure, the control terminal of the fourth transistor 51 is configured to receive the second scan signal Scan b, where the second scan signal Scan b is configured to control the fourth transistor 51 to be in the on state or the off state. Furthermore, the threshold voltage Vref is configured to selectively provide the pre-charge voltage for the storage capacitor 43 via the fourth transistor 51. The pre-charge voltage of the storage capacitor 43 is equal to the threshold voltage Vref.

When the second scan signal Scan b received at the control terminal of the fourth transistor 51 is at the first potential, the fourth transistor 51 is in the on state and the threshold voltage Vref provides the pre-charge voltage to the storage capacitor 43. When the second scan signal Scan b received at the control terminal of the fourth transistor 51 is at the second potential, the fourth transistor 51 is in the cut-off state and the threshold voltage Vref stops providing the pre-charge voltage to the storage capacitor 43.

It is to be understood that, the pre-charge voltage of the storage capacitor 43, i.e., the threshold voltage Vref, should be less than the voltage VGS at the control terminal of the third transistor 44, to avoid that the second transistor 42 and the third transistor 44 are mistakenly turned on in a pre-charge stage. The second transistor 42 and the third transistor 44 which are mistakenly turned on in the pre-charge stage cause the light-emitting element 45 to be mistakenly turned on, which in turn causes the display panel 10 to abnormally emit light.

In implementations of the disclosure, the first transistor 41, the second transistor 42, the third transistor 44, and the fourth transistor 51 may be N-type field effect thin film transistors, which are not specifically limited in the disclosure. The second transistor 42 and the third transistor 44 may also be P-type field effect thin film transistors, which are not specifically limited in the disclosure.

In implementations of the disclosure, the first terminal of each transistor may be a drain, the second terminal of each transistor may be a source, and the control terminal of each transistor may be a gate, which is not specifically limited in the disclosure.

In implementations of the disclosure, the fourth transistor 51 is set to selectively provide the pre-charge voltage for the storage capacitor 43, so that when the pixel circuit 50 is in the light-emitting stage, with the pre-charge voltage of the storage capacitor 43, the charging speed of the storage capacitor 43 can be accelerated, avoiding insufficient charging due to short scan time, insufficient light-emitting brightness of the light-emitting element 45 due to insufficient charging, and non-uniform display or ghosting of the display image on the display panel 10 due to insufficient light-emitting brightness of the light-emitting element 45. Furthermore, the fourth transistor 51 is set to selectively provide the pre-charge voltage for the storage capacitor 43, the coupling capacitance of the control terminal of the third transistor 44 can be effectively released, the control accuracy of the pixel circuit can be effectively improved and the accuracy of the light-emitting brightness control of the light-emitting element 45 can be improved. The display effect and display taste of the display panel 10 can be effectively enhanced.

Figure 6:
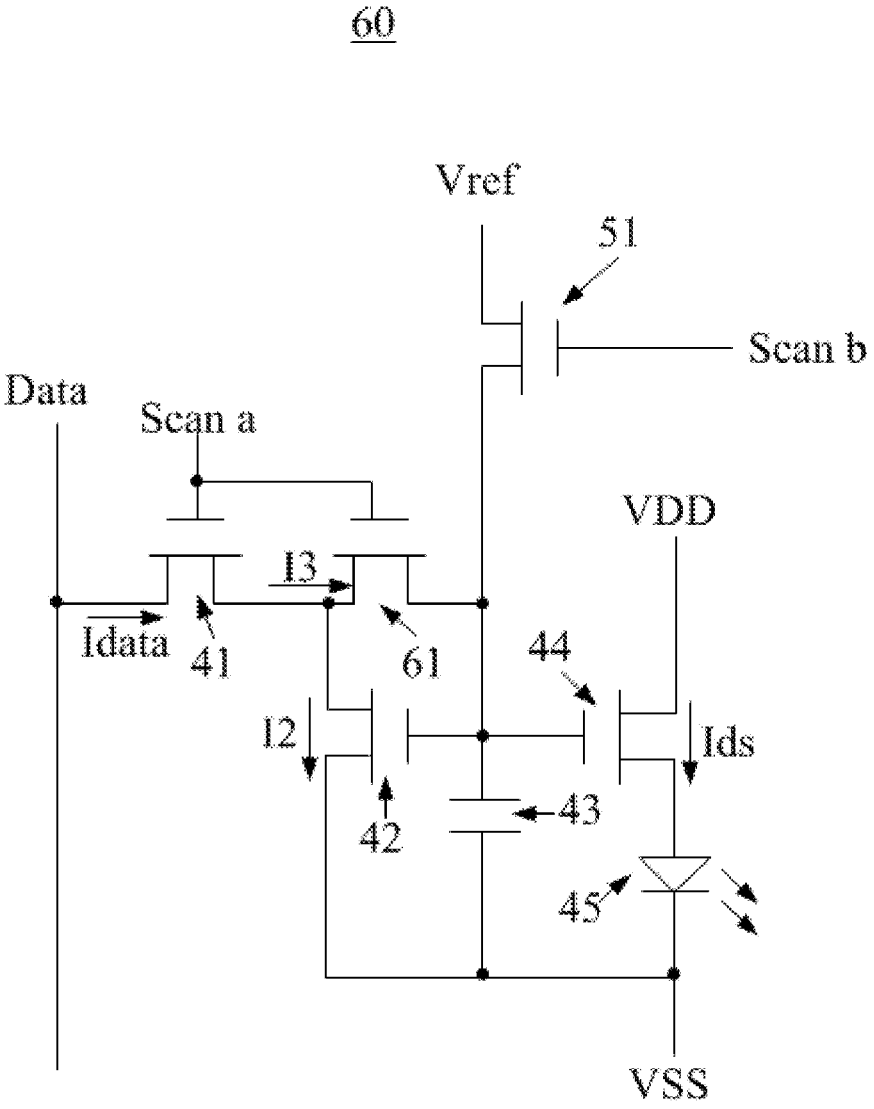
FIG. 6 is a schematic diagram of a circuit structure of a pixel circuit disclosed in a third implementation of the disclosure.

Referring to FIG. 6, FIG. 6 is a schematic diagram of a circuit structure of a pixel circuit 60 disclosed in a third implementation of the disclosure. In the implementation of the disclosure, the pixel circuit 60 disclosed in the third implementation shown in FIG. 6 differs from the pixel circuit 50 disclosed in the second implementation in that: the pixel circuit 60 further includes a fifth transistor 61, a control terminal of the fifth transistor 61 is electrically connected to the control terminal of the first transistor 41, for receiving the first scan signal Scan a. A first terminal of the fifth transistor 61 is electrically connected to the second terminal of the first transistor 41 and to the first terminal of the second transistor 42. A second terminal of the fifth transistor 61 is electrically connected to the second terminal of the fourth transistor 51.

When the first scan signal Scan a received at the control terminal of the first transistor 41 and the control terminal of the fifth transistor 61 is at the first potential and the second scan signal Scan b is at the second potential, the fourth transistor is in the off state and both the first transistor 41 and the fifth transistor 61 are in the on state. The data signal Data flows through the first transistor 41 and the fifth transistor 61 to charge the storage capacitor 43. When the voltage of the storage capacitor 43 reaches the preset voltage value, the storage capacitor 43 controls the second transistor 42 and the third transistor 44 to be in the on state. At this time, the third transistor 44 drives the light-emitting element 45 to selectively receive the second power supply voltage VDD, to further control the light-emitting element 45 to emit light at different degrees.

The preset voltage value of the storage capacitor 43 is determined according to the light-emitting brightness of the driven light-emitting element 45, i.e., the stronger the light-emitting brightness of the light-emitting element 45, the larger the preset voltage value. Furthermore, by controlling the magnitude of the data signal Data, the storage capacitor 43 can be charged to different preset voltage values, and thus the light-emitting element 45 emit light at different degrees when receiving the second power supply voltage VDD.

When the first scan signal Scan a received at the control terminal of the first transistor 41 and the control terminal of the fifth transistor 61 is at the second potential, the first transistor 41 and the fifth transistor 61 are in the off state. At this time, when the second scan signal Scan b received at the fourth transistor 51 is at the first potential, the fourth transistor 51 is in the on state and the threshold voltage Vref provides the pre-charge voltage for the storage capacitor 43, i.e., the fourth transistor and the fifth transistor provide the pre-charge voltage for the storage capacitor.

In implementations of the disclosure, the fifth transistor 61 operates in the cut-off region and the saturation region, which is not specifically limited in the disclosure.

In implementations of the disclosure, the fifth transistor 61 may be an N-type field effect thin film transistor, which is not specifically limited in the disclosure.

In implementations of the disclosure, the first terminal of each transistor may be a drain, the second terminal of each transistor may be a source, and the control terminal of each transistor may be a gate, which is not specifically limited in the disclosure.

Figure 7:
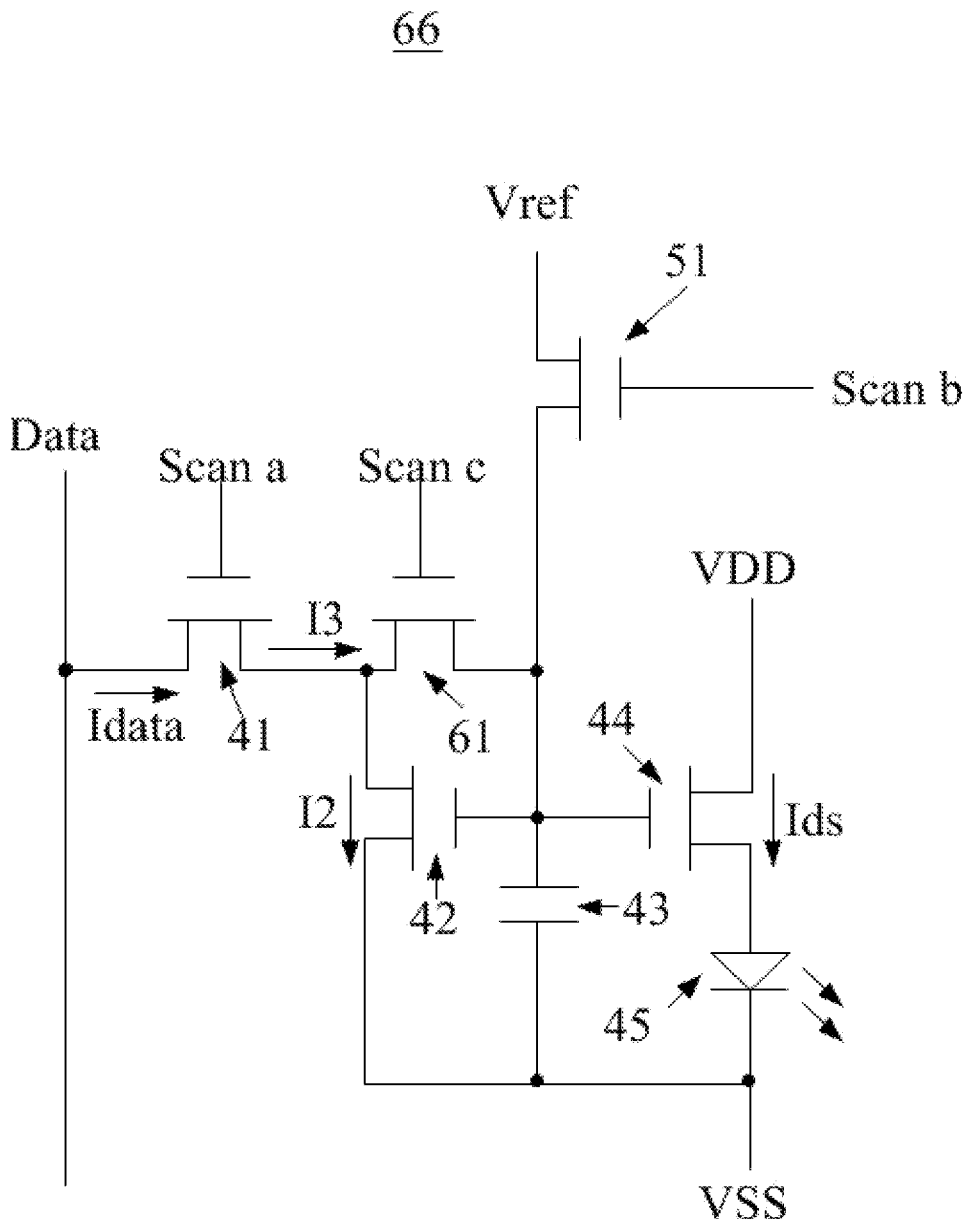
FIG. 7 is a schematic diagram of a circuit structure of a pixel circuit disclosed in a fourth implementation of the disclosure.

Referring to FIG. 7, FIG. 7 is a schematic diagram of a circuit structure of a pixel circuit 66 disclosed in a fourth implementation of the disclosure. In the implementation of the disclosure, the pixel circuit 66 disclosed in the fourth implementation shown in FIG. 7 differs from the pixel circuit 60 disclosed in the third implementation in that: the control terminal of the fifth transistor 61 is configured to receive the third scan signal Scan c and the control terminal of the first transistor 41 is configured to receive the first scan signal Scan a. In the third implementation, the control terminal of the fifth transistor 61 and the control terminal of the first transistor 41 are configured to receive the first scan signal Scan a. In other words, the pixel circuit 66 in the implementation controls the first transistor 41 and the fifth transistor 61 in the on state or the off state respectively, thereby obtaining different circuit control structures.

In implementations of the disclosure, the pixel circuit 66 includes the fifth transistor 61. The control terminal of the fifth transistor 61 is configured to receive the third scan signal Scan c, the first terminal of the fifth transistor 61 is electrically connected to both the second terminal of the first transistor 41 and the first terminal of the second transistor 42, and the second terminal of the fifth transistor 61 is electrically connected to the second terminal of the fourth transistor 51.

In implementations of the disclosure, when the first scan signal Scan a is at the second potential and the second scan signal Scan b and the third scan signal Scan c are both at the first potential, the first transistor 41 is in the off state and the fourth transistor 51 and the fifth transistor 61 are in the on state. The fourth transistor 51 and the fifth transistor 61 provide the pre-charge voltage for the storage capacitor 43. At this time, the pre-charge voltage of the storage capacitor 43 is the sum of a threshold voltage Vth of the third transistor 44 and the voltage VGS at the control terminal of the third transistor 44.

When the first scan signal Scan a and the third scan signal Scan c are at the first potential and the second scan signal Scan b is at the second potential, the first transistor 41 and the fifth transistor 61 are in the on state and the fourth transistor 51 is in the off state. At this time, the data signal Data charges the storage capacitor 43. When the voltage of the storage capacitor 43 reaches the preset voltage value, the storage capacitor 43 controls the second transistor 42 and the third transistor 44 to be in the on state. Furthermore, the second power supply voltage VDD flows from the first terminal of the third transistor 44 through the second terminal to the light-emitting element 45, and the light-emitting element 45 receives the second power supply voltage VDD and then emits light.

In implementations of the disclosure, the first scan signal Scan a and the third scan signal Scan c are set to respectively control on or off of the first transistor 41 and the fifth transistor 61, to provide the pre-charge voltage for the storage capacitor 43. As such, when the pixel circuit 50 is in the light-emitting stage, with the pre-charge voltage of the storage capacitor 43, the charging speed of the storage capacitor 43 can be accelerated, avoiding insufficient charging due to short scan time, insufficient light-emitting brightness of the light-emitting element 45 due to insufficient charging, and non-uniform display or ghosting of the display image on the display panel 10 due to insufficient light-emitting brightness of the light-emitting element 45. Thus, the display effect and display taste of the display panel 10 can be effectively improved.

Figure 8:
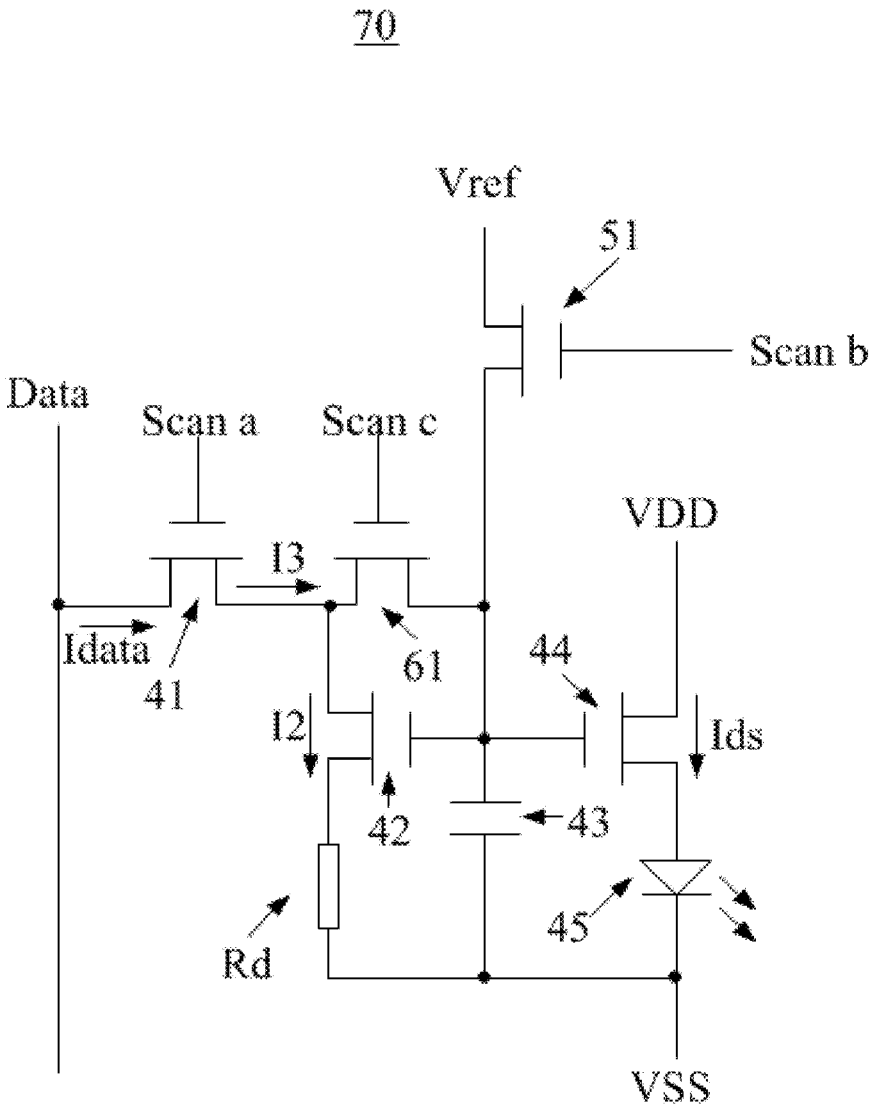
FIG. 8 is a schematic diagram of a circuit structure of a pixel circuit disclosed in a fifth implementation of the disclosure.

Referring to FIG. 8, FIG. 8 is a schematic diagram of a circuit structure of a pixel circuit 70 disclosed in a fifth implementation of the disclosure. In the implementation of the disclosure, the pixel circuit 70 disclosed in the fifth implementation shown in FIG. 8 differs from the pixel circuit 66 disclosed in the fourth implementation in that: the pixel circuit 70 further includes a resistor Rd, where one terminal of the resistor Rd is electrically connected to the second terminal of the second transistor 42 and the other terminal of the resistor Rd is electrically connected to the first power supply terminal.

It can be understood that, in other implementations of the disclosure, i.e., in the first implementation to the sixth implementation, each of the pixel circuits may include the resistor Rd, one terminal of the resistor Rd is electrically connected to the second terminal of the second transistor 42, and the other terminal of the resistor Rd is electrically connected to the first power supply terminal.

In implementations of the disclosure, the resistance value of the resistor Rd is equal to the resistance value of the light-emitting element 45.

In implementations of the disclosure, by setting the resistor Rd, more types of the second transistor 42 and the third transistor 44 can be selected, so that the compatibility of the pixel circuit 70 can be higher, the transistor more matched with the pixel circuit 70 can be used, the control accuracy of the pixel circuit 70 can be improved, the display accuracy of the display panel 10 can be improved, and the accuracy of eliminating non-uniform brightness or ghosting of the display panel 10 can be further improved.

Figure 9:
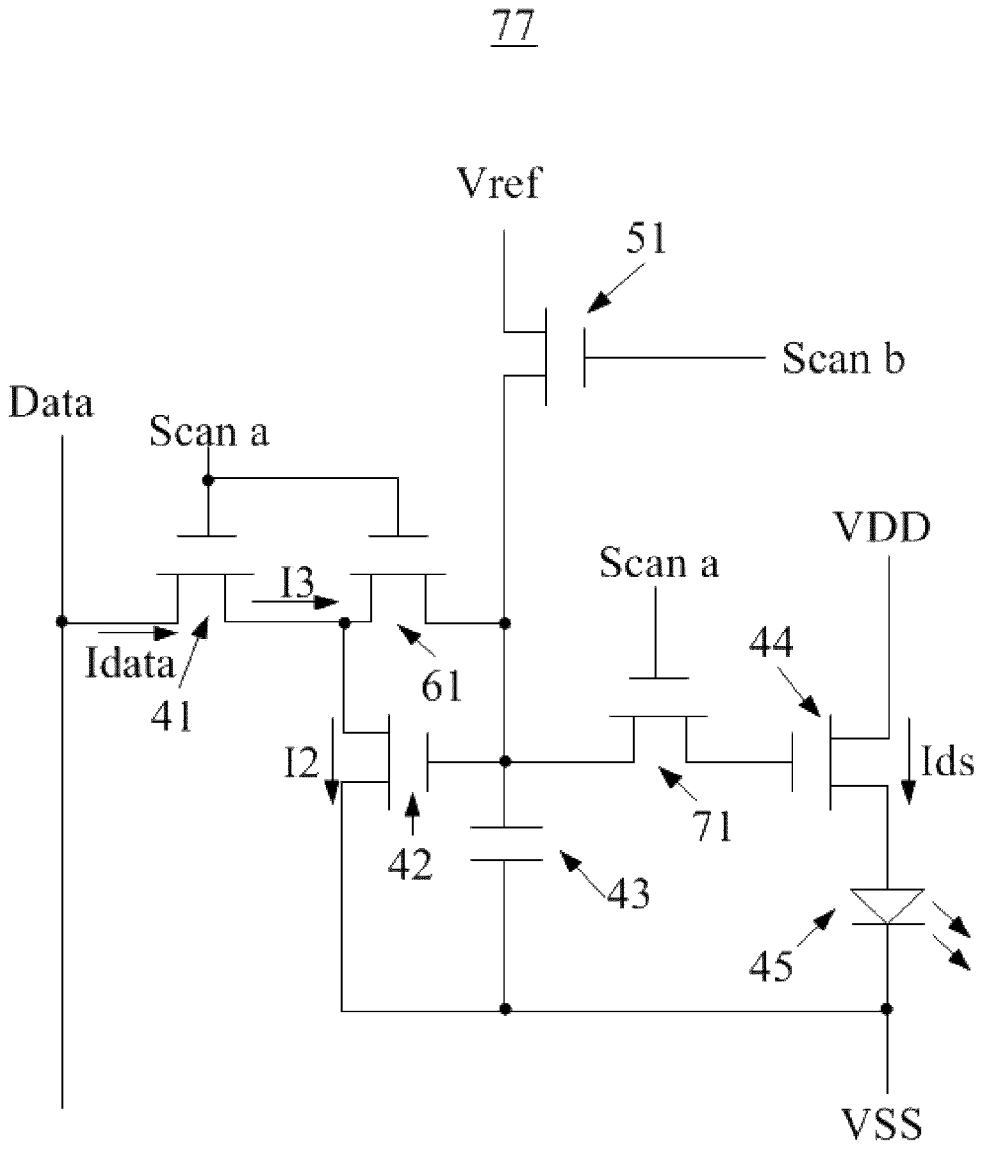
FIG. 9 is a schematic diagram of a circuit structure of a pixel circuit disclosed in a sixth implementation of the disclosure.

Referring to FIG. 9, FIG. 9 is a schematic diagram of a circuit structure of a pixel circuit 77 disclosed in the sixth implementation of the disclosure.

In implementations of the disclosure, the pixel circuit 77 disclosed in the sixth implementation shown in FIG. 9 differs from the pixel circuit 60 disclosed in the third implementation in that: the pixel circuit 77 further includes a sixth transistor 71. A control terminal of the sixth transistor 71 is configured to receive the first scan signal Scan a, a first terminal of the sixth transistor 71 is electrically connected to the control terminal of the second transistor 42, and a second terminal of the sixth transistor 71 is electrically connected to the control terminal of the third transistor 44.

In implementations of the disclosure, the sixth transistor 71 is configured to receive the first scan signal Scan a, and the first scan signal Scan a is configured to control the sixth transistor 71 to be in the on state or the off state.

Specifically, when the first scan signal Scan a received at the sixth transistor 71 is at the first potential, the sixth transistor 71 is in the on state. When the first scan signal Scan a received at the sixth transistor 71 is at the second potential, the sixth transistor 71 is in the off state.

In implementations of the disclosure, when the first scan signal Scan a is at the second potential and the second scan signal Scan b is at the first potential, the fourth transistor 51 is in the on state and the first transistor 41, the fifth transistor 61, and the sixth transistor 71 are all in the off state. At this time, the threshold voltage Vref provides the pre-charge voltage for the storage capacitor 43 through the fourth transistor 51. Since the sixth transistor 71 has an isolation function, the pre-charge voltage of the storage capacitor 43 is greater.

When the first scan signal Scan a is at the first potential and the second scan signal Scan b is at the second potential, the fourth transistor 51 is in the off state and the first transistor 41, the fifth transistor 61, and the sixth transistor 71 are all in the on state. At this time, the data signal Data charges the storage capacitor 43. When the voltage of the storage capacitor 43 reaches the preset voltage value, the storage capacitor 43 controls the second transistor 42 and the third transistor 44 to be in the on state. Furthermore, the light-emitting element 45 emits light upon receiving the second power supply voltage VDD.

In implementations of the disclosure, the sixth transistor 71 may be an N-type field effect thin film transistor, which is not specifically limited by the disclosure.

In implementations of the disclosure, the first terminal of each transistor may be a drain, the second terminal of each transistor may be a source, and the control terminal of each transistor may be a gate, which is not specifically limited by the disclosure.

It can be understood that, in the second implementation to the sixth implementation of the disclosure, the pixel circuit may also include the sixth transistor 71, the control terminal of the sixth transistor 71 is configured to receive the first scan signal Scan a, the first terminal of the sixth transistor 71 is electrically connected to the control terminal of the second transistor 42, the second terminal of the sixth transistor 71 is electrically connected to the control terminal of the third transistor 44.

In implementations of the disclosure, the sixth transistor 71 receives the first scan signal Scan a, and the first scan signal Scan a controls the sixth transistor 71 to be in the on state or the off state. In this way, the sixth transistor 71, serving as an isolation capacitor, achieves an enhanced pre-charging effect of selectively providing the pre-charge voltage to the storage capacitor 43 via the fourth transistor 51, that is, the storage capacitor 43 can be pre-charged with a larger voltage, further improving the charging speed of the storage capacitor 43.

In implementations of the disclosure, by setting the sixth transistor 71 and adopting an isolation effect thereof, a greater pre-charge voltage is provided to the storage capacitor 43. With the pre-charge voltage of the storage capacitor 43, the charging speed of the storage capacitor 43 can be accelerated, avoiding insufficient charging and insufficient light-emitting brightness of the light-emitting element 45 due to short scan time, and non-uniform display or ghosting of the display image on the display panel 10 due to insufficient charging and insufficient light-emitting brightness of the light-emitting element 45. Thus, the display effect and display taste of the display panel 10 can be effectively improved.

Based on the same concept, implementations of the disclosure further provide a display panel 10. The display panel 10 includes the pixel circuit of the preceding implementations, where the pixel circuit is configured to display an image on the display panel 10.

Based on the same concept, implementations of the disclosure further provide a display device 1000. The display device 1000 includes the above display panel 10.

In the schematic implementations of the disclosure, as shown in FIG. 1, the display device 1000 may further include the power supply module 20 and the support frame 30. The display panel 10 is fixed to the support frame 30 and the power supply module 20 is disposed at the back of the display panel 10. The display panel 10 is configured to display images (or pictures or screens), the power supply module 20 is electrically connected to the display panel 10, for providing the power supply voltage for image display of the display panel 10, and the support frame 30 is configured to provide support and protection for the display panel 10 and the power supply module 20.

In the pixel circuit, the display panel 10, and the display device 1000 of implementations of the disclosure, the second transistor 42 is provided and the second transistor 42 and the third transistor 44 are mirror-connected with respect to the storage capacitor 43. It can be derived from the control-drive principle in the circuit that: the fourth current Ids driving the light-emitting element 45 to emit light is only related to the first current Idata. Thus, it is possible to avoid non-uniform brightness of each light-emitting element 45 of the display panel 10 due to the threshold voltage drift of the transistor, carrier mobility instability or inherent hysteresis effect, the impedance drop of the driving power supply voltage, the aged light-emitting element 45, and non-uniform brightness or retention of the display image on the display panel 10 due to non-uniform brightness of each light-emitting element 45.

Meanwhile, by setting the fourth transistor 51, or by setting the fourth transistor 51 and the sixth transistor 71, or by setting the fourth transistor 51, the fifth transistor 61, and the sixth transistor 71, to provide the pre-charge voltage for the storage capacitor 43, the charging speed of the storage capacitor 43 can be accelerated with the pre-charge voltage of the storage capacitor 43 when the pixel circuit 50 is in the light-emitting stage. As such, insufficient charging and insufficient light-emitting brightness of the light-emitting element 45 caused by short scan time and non-uniform display or sticking of the display image on the display panel 10 can be avoided, thereby effectively improving the display effect and display taste of the display panel 10.

All possible combinations of technical features of the above implementations are described. However, as long as these combinations of the technical features are not contradictory, they should be considered to be within the scope of the specification.

In the description of the specification, the description of the reference terms "an implementation", "some implementations", "exemplary implementations", "examples", "specific examples" or "some examples", etc. mean that a particular feature, structure, material, or characteristic described in combination with the implementation or example is included in at least one implementation or example of the disclosure. In the specification, schematic representations of the above terms do not necessarily refer to the same implementation or example. Furthermore, the particular features, structures, materials, or characteristics described may be combined in a suitable manner in any one or more implementations or examples.

It should be understood that the above implementations express only several implementations of the disclosure, and their descriptions are more specific and detailed, but they should not be construed as a limitation of the scope of the patent application. It should be noted that for a person of ordinary skill in the art, several variations and improvements can be made without departing from the conception of the disclosure, and these variations and improvements belong to the scope of protection of the disclosure. Therefore, the scope of protection of the patent application shall be subject to the appended claims.

What is claimed is:

1. A pixel circuit, comprising a first transistor, a third transistor, a fourth transistor, a fifth transistor, a sixth transistor, a storage capacitor, and a light-emitting element, a control terminal of the first transistor being configured to receive a first scan signal, a first terminal of the first transistor being configured to receive a data signal, and the first transistor being configured to be turned on or turned off according to the first scan signal, wherein a control terminal of the third transistor is electrically connected to a second terminal of the first transistor, a first terminal of the third transistor is electrically connected to a second power supply terminal to receive a second power supply voltage, a second terminal of the third transistor is electrically connected to a first terminal of the light-emitting element, a second terminal of the light-emitting element is electrically connected to a first power supply terminal to receive a first power supply voltage, a first terminal of the storage capacitor is electrically connected to the second terminal of the first transistor and the control terminal of the third transistor, and a second terminal of the storage capacitor is electrically connected to the first power supply terminal; and wherein the pixel circuit further comprises a second transistor, a control terminal of the second transistor is electrically connected to the second terminal of the first transistor, the control terminal of the third transistor, and the first terminal of the storage capacitor, a first terminal of the second transistor is electrically connected to the second terminal of the first transistor, and a second terminal of the second transistor is electrically connected to the first power supply terminal, wherein a control terminal of the fourth transistor is configured to receive a second scan signal, a first terminal of the fourth transistor is configured to receive a threshold voltage, and a second terminal of the fourth transistor is electrically connected to the first terminal of the storage capacitor; and wherein the second scan signal is configured to control the threshold voltage to be selectively transmit to the storage capacitor to provide a pre-charge voltage for the storage capacitor; a first terminal of the fifth transistor is electrically connected to both the second terminal of the first transistor and the first terminal of the second transistor, a second terminal of the fifth transistor is electrically connected to the second terminal of the fourth transistor, and a control terminal of the fifth transistor is configured to receive the first scan signal or a third scan signal; and a control terminal of the sixth transistor is configured to receive the first scan signal, a first terminal of the sixth transistor is electrically connected to the control terminal of the second transistor, and a second terminal of the sixth transistor is electrically connected to the control terminal of the third transistor.

2. The pixel circuit of claim 1, wherein when the first scan signal is at a first potential, the first transistor is in an on state, and the data signal is transmitted to the storage capacitor to charge the storage capacitor; when a voltage of the storage capacitor reaches a preset voltage value, the second transistor and the third transistor are turned on, the second power supply voltage flows through the third transistor and is transmitted to the light-emitting element, and the second power supply voltage drives the light-emitting element to emit light; and when the first scan signal is at a second potential, the first transistor is in an off state.

3. The pixel circuit of claim 1, wherein when the second scan signal received at the control terminal of the fourth transistor is at a first potential, the fourth transistor is in an on state, and the threshold voltage provides the pre-charge voltage for the storage capacitor; and when the second scan signal received at the control terminal of the fourth transistor is at a second potential, the fourth transistor is in an off state, and the threshold voltage stops providing the pre-charge voltage for the storage capacitor.

4. The pixel circuit of claim 1, wherein the control terminal of the fifth transistor is configured to receive the third scan signal, and when the first scan signal is at a second potential and the second scan signal and the third scan signal each are at a first potential, the first transistor is in an off state, the fourth transistor and the fifth transistor are in an on state, and the fifth transistor and the fourth transistor provide the pre-charge voltage for the storage capacitor; and when the first scan signal and the third scan signal are at the first potential and the second scan signal is at the second potential, the first transistor and the fifth transistor are in the on state, the fourth transistor is in the off state, and the data signal charges the storage capacitor; or the control terminal of the fifth transistor is configured to receive the first scan signal, and when the first scan signal is at the first potential and the second scan signal is at the second potential, the first transistor and the fifth transistor each are in the on state, and the fourth transistor is in the off state, and the data signal flows through the first transistor and the fifth transistor to charge the storage capacitor; and when the first scan signal is at the second potential and the second scan signal is at the first potential, the first transistor and the fifth transistor each are in the off state, the fourth transistor is in the on state, and the fourth transistor and the fifth transistor provide the pre-charge voltage for the storage capacitor.

5. The pixel circuit of claim 1, wherein the pixel circuit further comprises a resistor, one terminal of the resistor is electrically connected to the second terminal of the second transistor, and the other terminal of the resistor is electrically connected to the first power supply terminal.

6. The pixel circuit of claim 2, wherein the pixel circuit further comprises a resistor, one terminal of the resistor is electrically connected to the second terminal of the second transistor, and the other terminal of the resistor is electrically connected to the first power supply terminal.

7. The pixel circuit of claim 3, wherein the pixel circuit further comprises a resistor, one terminal of the resistor is electrically connected to the second terminal of the second transistor, and the other terminal of the resistor is electrically connected to the first power supply terminal.

8. A display panel, comprising a pixel circuit comprising a first transistor, a third transistor, a fourth transistor, a fifth transistor, a sixth transistor, a storage capacitor, and a light-emitting element, a control terminal of the first transistor being configured to receive a first scan signal, a first terminal of the first transistor being configured to receive a data signal, and the first transistor being configured to be turned on or turned off according to the first scan signal, wherein a control terminal of the third transistor is electrically connected to a second terminal of the first transistor, a first terminal of the third transistor is electrically connected to a second power supply terminal to receive a second power supply voltage, a second terminal of the third transistor is electrically connected to a first terminal of the light-emitting element, a second terminal of the light-emitting element is electrically connected to a first power supply terminal to receive a first power supply voltage, a first terminal of the storage capacitor is electrically connected to the second terminal of the first transistor and the control terminal of the third transistor, and a second terminal of the storage capacitor is electrically connected to the first power supply terminal; and wherein the pixel circuit further comprises a second transistor, a control terminal of the second transistor is electrically connected to the second terminal of the first transistor, the control terminal of the third transistor, and the first terminal of the storage capacitor, a first terminal of the second transistor is electrically connected to the second terminal of the first transistor, and a second terminal of the second transistor is electrically connected to the first power supply terminal, wherein a control terminal of the fourth transistor is configured to receive a second scan signal, a first terminal of the fourth transistor is configured to receive a threshold voltage, and a second terminal of the fourth transistor is electrically connected to the first terminal of the storage capacitor; and wherein the second scan signal is configured to control the threshold voltage to be selectively transmit to the storage capacitor to provide a pre-charge voltage for the storage capacitor; a first terminal of the fifth transistor is electrically connected to both the second terminal of the first transistor and the first terminal of the second transistor, a second terminal of the fifth transistor is electrically connected to the second terminal of the fourth transistor, and a control terminal of the fifth transistor is configured to receive the first scan signal or a third scan signal; and a control terminal of the sixth transistor is configured to receive the first scan signal, a first terminal of the sixth transistor is electrically connected to the control terminal of the second transistor, and a second terminal of the sixth transistor is electrically connected to the control terminal of the third transistor; and the pixel circuit is configured to display an image on the display panel.

9. The display panel of claim 8, wherein when the first scan signal is at a first potential, the first transistor is in an on state, and the data signal is transmitted to the storage capacitor to charge the storage capacitor; when a voltage of the storage capacitor reaches a preset voltage value, the second transistor and the third transistor are turned on, the second power supply voltage flows through the third transistor and is transmitted to the light-emitting element, and the second power supply voltage drives the light-emitting element to emit light; and when the first scan signal is at a second potential, the first transistor is in an off state.

10. The display panel of claim 8, wherein when the second scan signal received at the control terminal of the fourth transistor is at a first potential, the fourth transistor is in an on state, and the threshold voltage provides the pre-charge voltage for the storage capacitor; and when the second scan signal received at the control terminal of the fourth transistor is at a second potential, the fourth transistor is in an off state, and the threshold voltage stops providing the pre-charge voltage for the storage capacitor.

11. The display panel of claim 8, wherein the control terminal of the fifth transistor is configured to receive the third scan signal, and when the first scan signal is at a second potential and the second scan signal and the third scan signal each are at a first potential, the first transistor is in an off state, the fourth transistor and the fifth transistor are in an on state, and the fifth transistor and the fourth transistor provide the pre-charge voltage for the storage capacitor; and when the first scan signal and the third scan signal are at the first potential and the second scan signal is at the second potential, the first transistor and the fifth transistor are in the on state, the fourth transistor is in the off state, and the data signal charges the storage capacitor; or the control terminal of the fifth transistor is configured to receive the first scan signal, and when the first scan signal is at the first potential and the second scan signal is at the second potential, the first transistor and the fifth transistor each are in the on state, and the fourth transistor is in the off state, and the data signal flows through the first transistor and the fifth transistor to charge the storage capacitor; and when the first scan signal is at the second potential and the second scan signal is at the first potential, the first transistor and the fifth transistor each are in the off state, the fourth transistor is in the on state, and the fourth transistor and the fifth transistor provide the pre-charge voltage for the storage capacitor.

12. The display panel of claim 8, wherein the pixel circuit further comprises a resistor, one terminal of the resistor is electrically connected to the second terminal of the second transistor, and the other terminal of the resistor is electrically connected to the first power supply terminal.

13. The display panel of claim 9, wherein the pixel circuit further comprises a resistor, one terminal of the resistor is electrically connected to the second terminal of the second transistor, and the other terminal of the resistor is electrically connected to the first power supply terminal.

14. The display panel of claim 10, wherein the pixel circuit further comprises a resistor, one terminal of the resistor is electrically connected to the second terminal of the second transistor, and the other terminal of the resistor is electrically connected to the first power supply terminal.

15. A display device comprising a display panel, the display panel comprising a pixel circuit comprising a first transistor, a third transistor, a fourth transistor, a fifth transistor, a sixth transistor, a storage capacitor, and a light-emitting element, a control terminal of the first transistor being configured to receive a first scan signal, a first terminal of the first transistor being configured to receive a data signal, and the first transistor being configured to be turned on or turned off according to the first scan signal, wherein a control terminal of the third transistor is electrically connected to a second terminal of the first transistor, a first terminal of the third transistor is electrically connected to a second power supply terminal to receive a second power supply voltage, a second terminal of the third transistor is electrically connected to a first terminal of the light-emitting element, a second terminal of the light-emitting element is electrically connected to a first power supply terminal to receive a first power supply voltage, a first terminal of the storage capacitor is electrically connected to the second terminal of the first transistor and the control terminal of the third transistor, and a second terminal of the storage capacitor is electrically connected to the first power supply terminal; and wherein the pixel circuit further comprises a second transistor, a control terminal of the second transistor is electrically connected to the second terminal of the first transistor, the control terminal of the third transistor, and the first terminal of the storage capacitor, a first terminal of the second transistor is electrically connected to the second terminal of the first transistor, and a second terminal of the second transistor is electrically connected to the first power supply terminal, wherein a control terminal of the fourth transistor is configured to receive a second scan signal, a first terminal of the fourth transistor is configured to receive a threshold voltage, and a second terminal of the fourth transistor is electrically connected to the first terminal of the storage capacitor; and wherein the second scan signal is configured to control the threshold voltage to be selectively transmit to the storage capacitor to provide a pre-charge voltage for the storage capacitor; a first terminal of the fifth transistor is electrically connected to both the second terminal of the first transistor and the first terminal of the second transistor, a second terminal of the fifth transistor is electrically connected to the second terminal of the fourth transistor, and a control terminal of the fifth transistor is configured to receive the first scan signal or a third scan signal; and a control terminal of the sixth transistor is configured to receive the first scan signal, a first terminal of the sixth transistor is electrically connected to the control terminal of the second transistor, and a second terminal of the sixth transistor is electrically connected to the control terminal of the third transistor; and the pixel circuit is configured to display an image on the display panel.

16. The display device of claim 15, wherein when the first scan signal is at a first potential, the first transistor is in an on state, and the data signal is transmitted to the storage capacitor to charge the storage capacitor; when a voltage of the storage capacitor reaches a preset voltage value, the second transistor and the third transistor are turned on, the second power supply voltage flows through the third transistor and is transmitted to the light-emitting element, and the second power supply voltage drives the light-emitting element to emit light; and when the first scan signal is at a second potential, the first transistor is in an off state.

17. The display device of claim 15, wherein when the second scan signal received at the control terminal of the fourth transistor is at a first potential, the fourth transistor is in an on state, and the threshold voltage provides the pre-charge voltage for the storage capacitor; and when the second scan signal received at the control terminal of the fourth transistor is at a second potential, the fourth transistor is in an off state, and the threshold voltage stops providing the pre-charge voltage for the storage capacitor.

18. The display device of claim 15, wherein the control terminal of the fifth transistor is configured to receive the third scan signal, and when the first scan signal is at a second potential and the second scan signal and the third scan signal each are at a first potential, the first transistor is in an off state, the fourth transistor and the fifth transistor are in an on state, and the fifth transistor and the fourth transistor provide the pre-charge voltage for the storage capacitor; and when the first scan signal and the third scan signal are at the first potential and the second scan signal is at the second potential, the first transistor and the fifth transistor are in the on state, the fourth transistor is in the off state, and the data signal charges the storage capacitor; or the control terminal of the fifth transistor is configured to receive the first scan signal, and when the first scan signal is at the first potential and the second scan signal is at the second potential, the first transistor and the fifth transistor each are in the on state, and the fourth transistor is in the off state, and the data signal flows through the first transistor and the fifth transistor to charge the storage capacitor; and when the first scan signal is at the second potential and the second scan signal is at the first potential, the first transistor and the fifth transistor each are in the off state, the fourth transistor is in the on state, and the fourth transistor and the fifth transistor provide the pre-charge voltage for the storage capacitor.

19. The display device of claim 15, wherein the pixel circuit further comprises a resistor, one terminal of the resistor is electrically connected to the second terminal of the second transistor, and the other terminal of the resistor is electrically connected to the first power supply terminal.

20. The display device of claim 16, wherein the pixel circuit further comprises a resistor, one terminal of the resistor is electrically connected to the second terminal of the second transistor, and the other terminal of the resistor is electrically connected to the first power supply terminal.

* * * * *